United States Patent [19]

Mista

[11] Patent Number: 4,881,693

[45] Date of Patent: Nov. 21, 1989

[54] SPOOLING MACHINE WITH A PLURALITY OF WINDING HEADS

[75] Inventor: Kresimir Mista, Heusenstamm, Fed. Rep. of Germany

[73] Assignee: Karl Mayer Textilmaschinenfabrik GmbH, Obertshausen, Fed. Rep. of Germany

[21] Appl. No.: 202,196

[22] Filed: Jun. 3, 1988

[30] Foreign Application Priority Data

Jun. 6, 1987 [DE] Fed. Rep. of Germany ..... 3719091

[51] Int. Cl.[4] ..... B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 2,350,927 | 6/1944 | Reiners et al. | 242/35.5 A |
| 3,279,712 | 10/1966 | Furst | 242/35.5 R |
| 3,474,975 | 10/1969 | Brouwer et al. | 242/35.5 R |
| 4,010,907 | 3/1977 | Nishiyama et al. | 242/35.5 A |
| 4,666,095 | 5/1987 | Kupper | 242/35.5 A |
| 4,685,630 | 8/1987 | Buhren et al. | 242/35.5 A |
| 4,688,735 | 8/1987 | Shinji et al. | 242/35.5 A |
| 4,723,722 | 2/1988 | Roller | 242/35.5 A |

FOREIGN PATENT DOCUMENTS 353200 2/1987 Fed. Rep. of Germany .

OTHER PUBLICATIONS

Textile Industry, 72 (170), Issue 11, p. 827 (1970).
EP-OS 78 803, Larsson, published 02/1986.

*Primary Examiner*—Stanley N. Gilreath
*Attorney, Agent, or Firm*—Omri M. Behr

[57] ABSTRACT

A spooling machine with a plurality of winding heads and a delivery point for cops has a forwarding device which transports the cops from the delivery point to a cops-utilizing winding head. A discharge arrangement can displace the particular cops at the winding head. The forwarding arrangement comprises a moveable and slidable transport arrangement which moves along a track. The transport arrangement comprises a takeup arrangement and a discharge arrangement for only a single cop. A drive means operates on the path between the delivery point and the winding head.

13 Claims, 4 Drawing Sheets

Fig.9
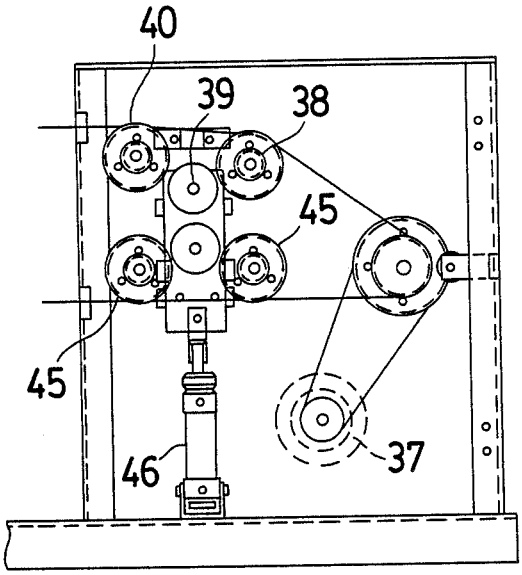
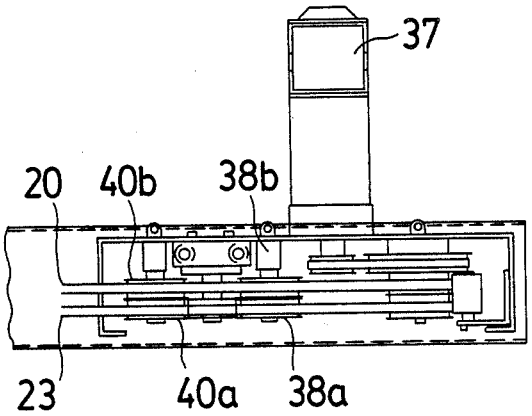
Fig.10

SPOOLING MACHINE WITH A PLURALITY OF WINDING HEADS

BACKGROUND OF THE INVENTION

The invention concerns a spooling machine with a plurality of winding heads, a delivery point for cops and a forwarding means which carries designated cops to a particular winding head together with a discharging mechanism which displaces the particular cops at this particular winding head.

A spooling machine of this type is known (DEOS-3504883) in which the cops are brought to the individual winding head by means of a horizontally oriented conveyor path. At each winding head a displacement arm is provided which can be swung over the conveyor path by means of a proximately located control motor so that the next following cop is displaced from the conveyor path and thrown off sideways and downwards into a small storage magazine for the appropriate winding head. This construction is rather expensive since it is necessary to provide a separate displacement arm with an appropriate control motor for each winding head.

In controlling this device it is also important to take care that the displacement arm is activated just before the arrival of the cops destined for that particular winding head, and to avoid interference with cops which are destined for other winding heads. Furthermore the cops, during their transportation on the conveyor path can come into contact with the walls of the guiding surfaces which can often lead to damage to the thread.

Thus there is a need for an improved spooling machine of the previously described type which is easier to construct, easier to control and which offers the possibility of rapid transportation of the cops to the appropriate winding head.

SUMMARY OF THE INVENTION

In accordance with the illustrative embodiments demonstrating features and advantages of the present invention there is provided a forwarding means in a spooling machine having a plurality of cop-utilizing winding heads and a delivery point for cops. The forwarding means can transport the cops from the delivery point to one of the cop-utilizing winding heads. The forwarding means comprises a drive means and a moveable or slidable transport arrangement. The drive means operates over the path between the delivery point and the winding heads. The moveable or slidable transport arrangement is mounted to move along a conveyor path. The transport arrangement comprises a takeup means and a discharge means. The takeup means can hold one of the cops. The discharge means can discharge the cops at one of the winding heads. The discharge means can operate to discharge only a single one of the cops.

By employing apparatus of the foregoing type an improved forwarding device is achieved. The preferred forwarding device uses a transport means which can travel along or be slid along a conveyor path, carrying a takeup arrangement for a single cop. A discharge arrangement as well as a drive arrangement can forward the cops over the path from the delivery point to the appropriate winding head on demand. In this spooling machine the discharge arrangement is actually located upon the transport means. Since, in this approach it is not necessary to provide each winding head with its own discharge arrangement the cost per winding head is small. Each transport means only carries a single cop. Therefore, the discharge arrangement does not have to distinguish between a plurality of cops. When the transportation means stops at the predetermined winding head, the discharge arrangement can be activated exclusively thereupon.

This, in toto, leads to a very simple and reliable control mechanism. Furthermore, there is obtained a comparatively lightweight transport arrangement. This in turn allows the arrangement to operate at a substantially higher speed. The takeup arrangement can ensure that a cop takes up a predetermined position therein and thus minimizes the danger that the thread can be damaged during the transportation step. This in turn provides that even at a high operating speed, the cop does not alter its position.

In a further embodiment it has been found desirable that the motor activates two chain or two belt drive arrangements, each separately connected with a different one of two mutually, directionally slidable parts of the transport arrangement. One of these two drive arrangements is led over a direction changing arrangement whose position is controlled by a control motor. The control motor can change the phasing of the two drive arrangements and thus bring the two slidable parts of the transport arrangement towards each other. By the presence of the two drive arrangements, it is possible to operate both the drives as well as their relative displacements in a rather simple manner.

BRIEF DESCRIPTION OF THE DRAWINGS

The invention may be illustrated by the following drawings which clearly illustrate the preferred embodiments.

FIG. 9 is an partial enlarged side elevational view of the left hand side of the machine shown in FIG. 1.

FIG. 10 is a downward plan view of the partial view of FIG. 9 wherein the cover portion of 11 has been removed.

DETAILED DESCRIPTION OF THE DRAWINGS

Figure 1:
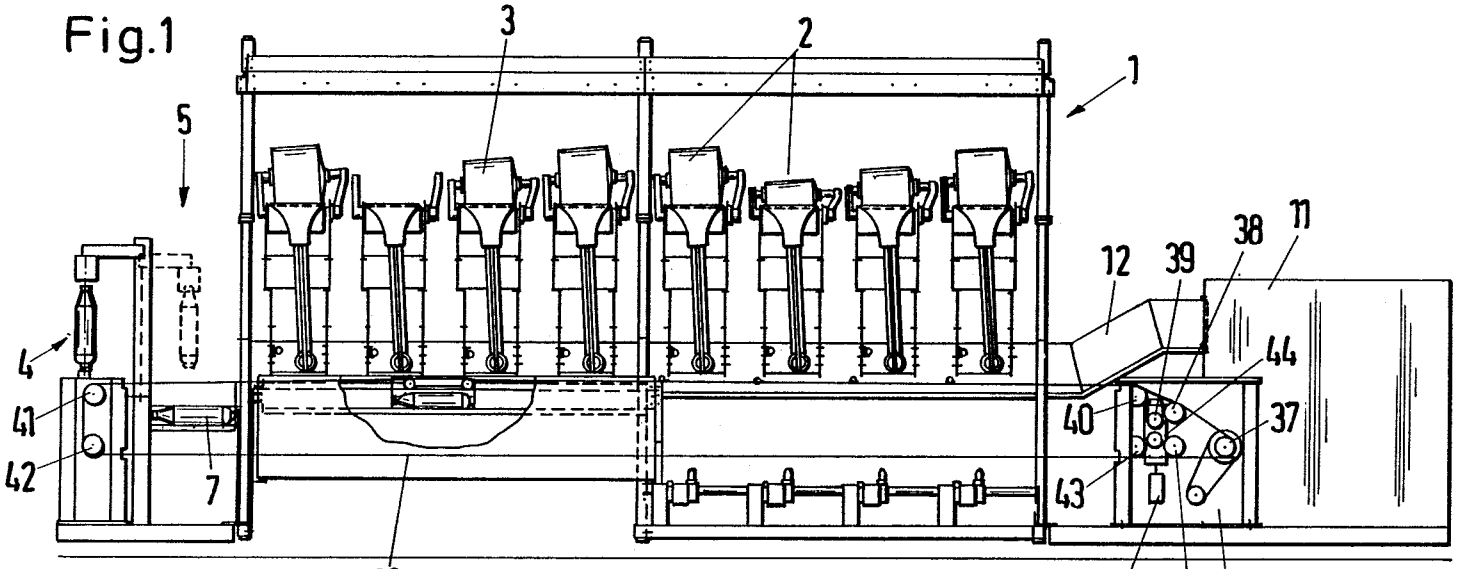
FIG. 1 is a side elevational view of a spooling machine of the present invention.
Figure 2:
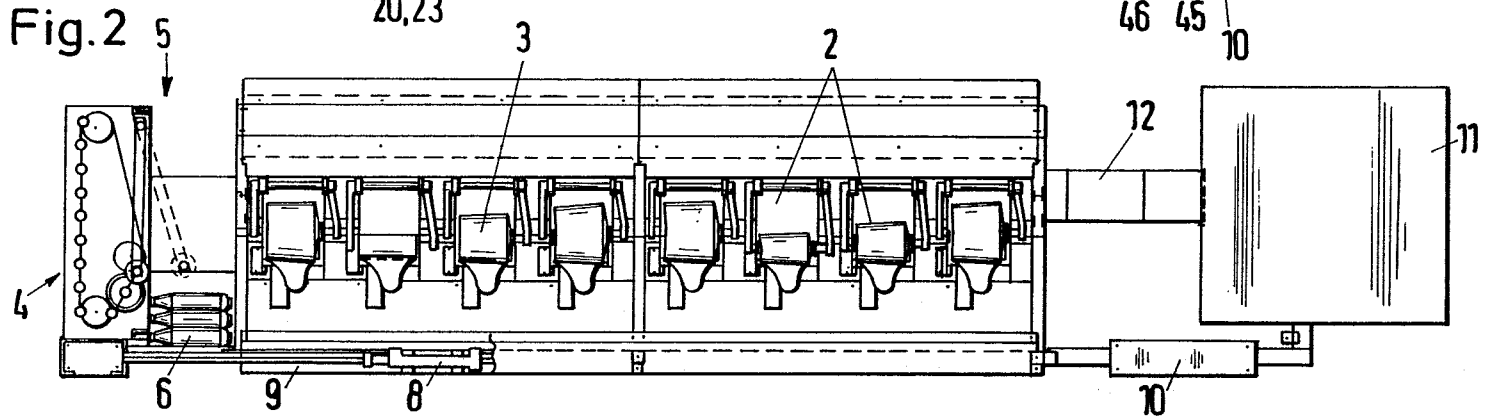
FIG. 2 is a plan view of the spooling machine of FIG. 1.

The spooling machine 1 illustrated in FIGS. 1 and 2 comprises eight winding heads 2, each of which serve the production of a single spool 3. The construction of these winding heads is conventional. At the left hand end of the machine there is provided a preparation station 4 with a subsequently provided delivery point 5 comprising a cops magazine 6. The cops 7 are transported from this delivery point by means of a transport means 8 along conveyor path 9 to each of the eight winding heads 2.

At the right hand end of the machine there is provided a central drive station 10 and a suction turbine 11 which is connected to the suction points of the spooling machine 1 by means of conduit 12.

Figure 3:
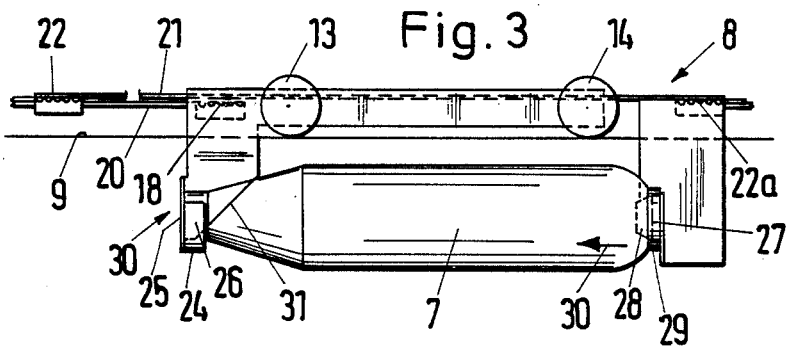
FIG. 3 is a side elevational view of a transport means carrying a cop.
Figure 4:
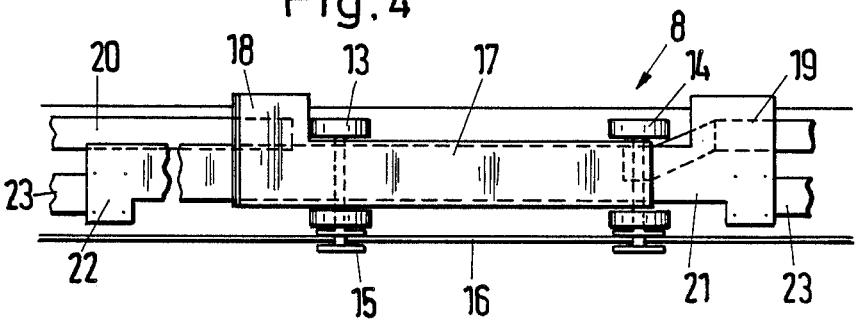
FIG. 4 is a downward plan view of the means of FIG. 3.

As is shown in FIGS. 3 and 4, each transport means 8 is provided with wheels 13 and 14 which can run along conveyor path 9, a horizontal ledge running the length of the spooling machine. Rim flanges 15 protrude over rail 16 of conveyor path 9 to ensure a more secure guidance of transportation means 8. The axles of wheels 13 and 14 are supported in segment 17 of the transport means 8. Segment 17 is preferably a sheet metal development having sides that support the axles of wheels 13 and 14. Ends 18 and 19 of tooth belt drive arrangement 20 are affixed to segment 17, either on its underside, on the inside of one of its side faces, or on a bracket (not shown).

A second drive arrangement 23, similarly in the form of a tooth belt, has its ends 22 and 22*a* attached similarly to a portion 21 of transport means 8. Portion 21 fits within and is slidably displaceable relative to segment 17. Segment 17 is a sheet metal development having a longitudinal side panel at its lower left end supporting a holding element 24 having a lateral clamping plate 25. Plate 25 is located on the forward face of holding element 24 which, suitably, has a U-formed cross section.

This holding element 24 is shaped to take up the end 26 of the cop's core. The part 21 has at its right end a side panel carrying holding element 27 which is provided with a cone shaped portion 28 which fits into the open cylindrical end 29 of the other end of the cop's core 26.

It is advantageous to have one of the fastening elements 24 grasp the underside of the core 26 of the cop and the other fastening element 27 intrude into the interior of the cops core with a cone. Since the undergrasp occurs on the spool-off end of the core, the thread on the inside of the core is not damaged. The introduction of the other holding element 27 into the interior of the cop's core 26 takes into account the fact that, generally speaking, this core end has a shorter free axial length.

In a preferred modification of the device the takeup arrangement 30 can include two holding elements which interact with the ends of the cop's core. This provides a predetermined and safe orientation of the cops during transportation. Furthermore, such holding elements only touch the cops core and not the thread. This further reduces the danger of damage to the thread. It is advantageous to provide a clamping element 25 to the takeup arrangement 30 to contact the face or circumferential surface of the cop's core 26 on the spool-off side. This way the thread end which is normally on the inside of the cops core can be tightly held so that it remains in a fixed location during the transportation. This is in contrast to the known transportation arrangements where the thread end is unsecured and can therefore, creep out of the inside of the core so that it is no longer locatable for the later knotting and splicing step.

In the illustrated position, the holding elements 24 and 27 effectuate the takeup arrangement 30 for the cop 7. In this mode, the end of the thread 31 which reaches into the interior of the cops core is held against the face or circumferential surface of the cop's core by clamping plate 25 of the holding element 24.

It is further advantageous to locate the takeup arrangement 30 underneath the conveyor path 9. The advantage of such a location is that it provides a good gravitational balance during transportation. Furthermore, none of the other segments of the transportation means 8 are liable to cause interference during the discharge step.

Figure 5:
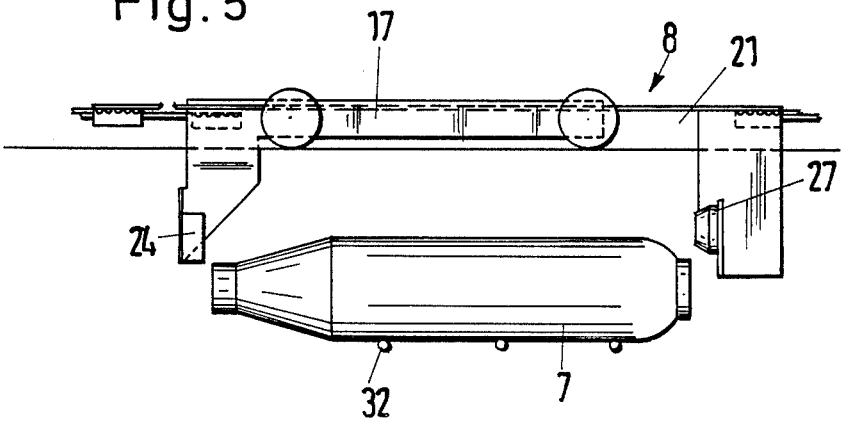
FIG. 5 is a side elevational view of a transport means as shown in FIG. 3 just prior to the takeup of a cops.
Figure 6:
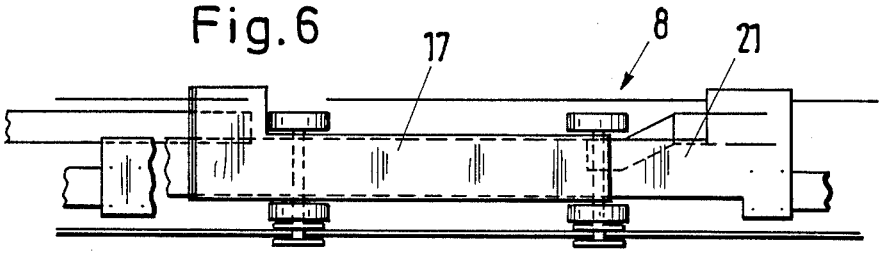
FIG. 6 is a downward plan view of the arrangement of FIG. 5.

FIGS. 5 and 6 illustrate the takeup position of the transport means 8 at the delivery point 5. The two portions 17 and 21 of the transport means are moved apart relative to each other in such a way that the holding elements 24 and 27 are moved apart from each other in a direction parallel to the conveyor path 9. A lifting arrangement 32 located in the vicinity of the delivery point 5 raises the cops 7 upwardly. Arrangement 32 may be a trio of parallel, upwardly moveable tines. The two holding elements 24 and 27 are then moved toward each other so that the cops 7 is securely held therebetween.

Figure 7:
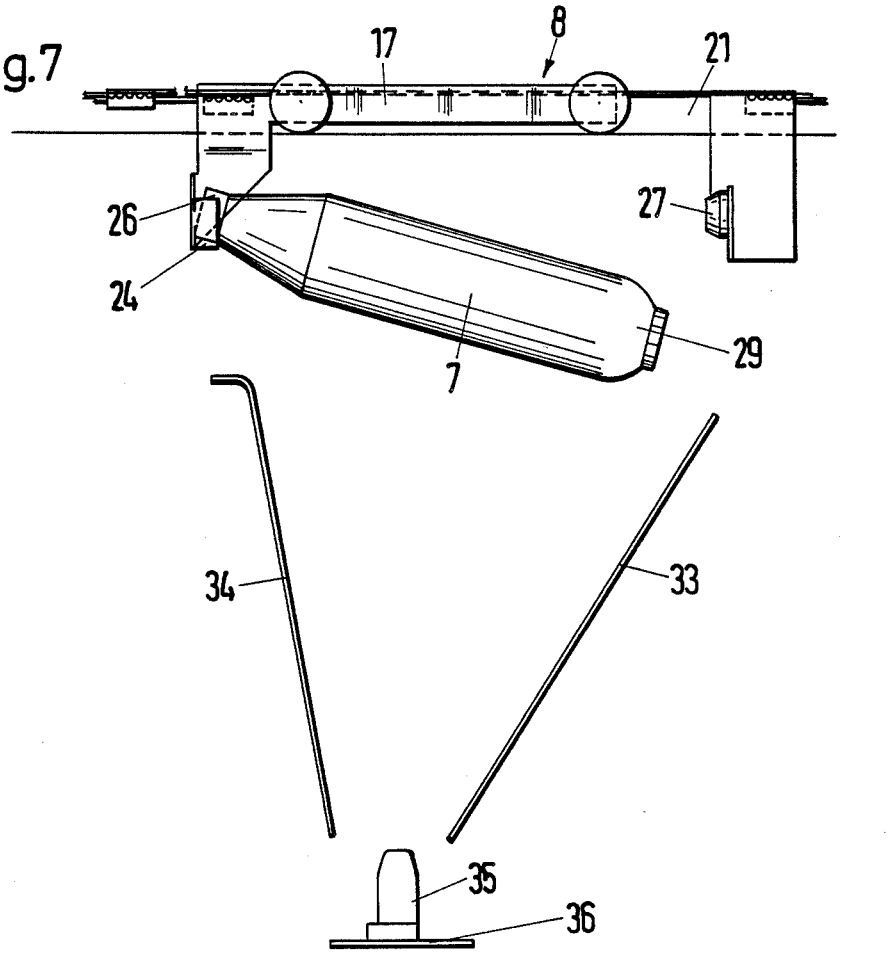
FIG. 7 is a side elevational view of the means of FIG. 3 at the moment of discharge of a cops, showing additionally the receiving means at the winding head.

FIG. 7 shows the transport means 8 at the winding head 36. At this location, portion 17 is held in place and portion 21 is moved to the right. The holding element 27 moves out of the end 29 of the cop's core so that the cop 7 tips downwardly from that end. The other core end 26 is still supported in the holding element 24.

Guide means 33 and 34 have faces converging downwardly. Guide means 33 is inclined more steeply away from the vertical. Guide means 33 and 34 ensure that the core end 29 is guided downwardly in such a way that the protrusion 35 on the transport band of winding head 36 enters into end 29 of the cop's core. Such an entrance ensures that cop 7 can then be further processed in the vertical orientation. The displacability of part 21 thus creates the throw-off arrangement.

It is advantageous to provide that the discharge means is formed by portion 21 of the takeup arrangement 30 which is moveable relative to the transport means 8. By displacement of portion 21, the cop 7 is released and guided to the winding head solely by the force of gravity.

It is yet more advantageous to provide that the two holding elements 24, 27 are attached to two slidable portions 17, 21 on the transportation means 8, which are displaceable relative to the direction of travel on the conveyor path 9. Portions 17 and 21 slide in relation to each other by action of a control motor (discussed hereinafter). When these portions 17 and 21 are displaced in a direction towards each other the cop 7 is held solidly. If they are displaced in the other direction, an ejection mechanism comes into play because then the cop 7 is liberated and drops under the force of gravity.

A control motor (discussed hereinafter) can be placed in a fixed location and operate upon the transportation means 8 and its drive arrangement. Hence, in order to activate the ejection mechanism it is not necessary to move the control motor with the transport means so that the mass of the latter may be held small. The drive arrangement may be provided by chains, belts, threaded rods or the like.

Referring to FIGS. 1–4, the drive station 10 comprises a motor 37 which drives both tooth belts comprising drive arrangements 20 and 23 (FIGS. 3 and 4). While drive arrangement 23 runs over all the guide rollers 38 to 45, drive arrangement 20 only goes over guide rollers 40 through 43 and guide rollers 38 and 45. Both of the guide rollers 39 and 44 are set in the same carriage and can be moved up and down by means of control motor 46, through for example, a jack screw (not shown). Such shifting effectively shortens the top stretch and lengthens the bottom stretch of belt 23 (or vice versa). This permits the relative displacement of drive means 23 with respect to drive means 20 in order to achieve the desired displacement of portions 17 and 21 with respect to each other.

In this preferred embodiment the transport means 8 is connected to fixedly located motor 37 via a drive arrangement 20, 23. Motor 37, in dependence upon the position of the appropriate winding head with respect to the delivery point, performs a predetermined number of revolutions or partial revolutions. Only a single forwarding command specifying the number of revolutions or partial revolutions corresponding to the distance between the delivery point and each spool station is necessary to bring the transport means to the correct winding head by means of a single forwarding command. After arrival, always by the same command, the discharge arrangement is activated. Guidance failures are therefore practically eliminated.

Furthermore, it is possible to provide that motor 37 is a step motor to which a predetermined number of pulses may be fed corresponding to the position of the desired winding head. Such step motors allow the transport means 8 to cover a predetermined path with great accuracy.

When a predetermined winding head 2 demands a cop, motor 37 receives a command to move itself by a predetermined number of steps or partial revolutions which number corresponds to the path length between the delivery point 5 and the winding head 2. This causes transport means 8 to move to the desired winding head 2. As soon as motor 37 is stopped, control motor 46 is activated whereby cop 7 is thrown off. Transport means 8 is then caused to return to its starting position where it is then charged with the next cop.

Figure 8:
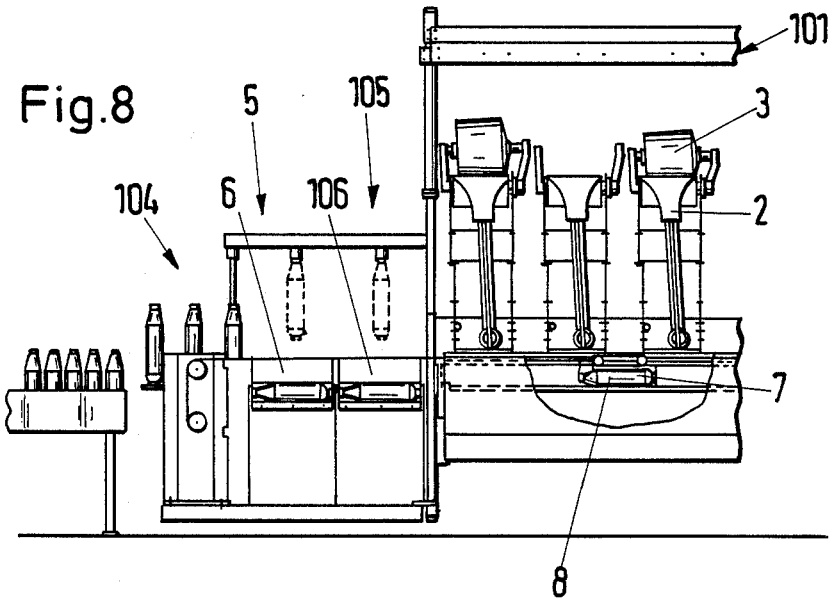
FIG. 8 is a partial side elevational view of a modified spooling machine.

In the modification shown in FIG. 8 the part numbers have the same meaning but are raised by one hundred units in designation number, but otherwise correspond to the designation of FIGS. 1 through 7.

Since a single transport arrangement can serve a large number of winding heads it is sometimes useful to provide at least two delivery points for cops with different threads and further to provide that each delivery point serves a predetermined winding head, this makes it possible to spool different threads on a single spooling machine.

The spooling machine 101 comprises a plurality of winding heads 2 for the provision of spools 3. The cops 7 are brought to the corresponding winding head 2. In this embodiment the preparation station 104 is provided with two delivery points 5, 105 each of which are formed by a magazine 6, 106. The magazine holds cops of different threads. Each magazine delivers to predetermined winding heads so that the spooling machine can spool two different types of thread.

Obviously many modifications and variations of the present invention are possible in light of the above teachings. It is therefore to be understood that within the scope of the appended claims, the invention may be practiced otherwise than as specifically described.

I claim:

1. In a spooling machine having a plurality of cop-utilizing winding heads and a delivery point for cops, a forwarding means for transporting the cops from the delivery point to a selected one of said cop-utilizing winding heads in response to a routing signal signifying said selected one of said winding heads, said forwarding means comprising:

a drive means operating over the path between the delivery point and the winding heads, said drive means including a control motor having an input for receiving said routing signal and controlling said motor, said motor being intermittently operable to an extent determined by said routing signal; and a moveable or slidable transport arrangement mounted to move along a conveyor path, said transport arrangement being coupled to and driven by said drive means, said transport arrangement comprising:

(a) a takeup means coupled to said drive means for holding one of said cops; and (b) a discharge means coupled to said drive means and mounted alongside said takeup means for discharging the cops at one of said winding heads, so that said transport arrangement can transport cops from said delivery point to said selected one of said winding heads.

2. In a spooling machine in accordance with claim 1 wherein the discharge means comprises:

a moving holder mounted on the takeup means, said moving holder being reciprocatable with respect to the transport arrangement to engage and disengage one of said cops.

3. In a spooling machine in accordance with claim 1 wherein the takeup means has a lower region for engaging one of said cops and above said lower region an upper region for supporting said takeup means.

4. In a spooling machine in accordance with claim 1 wherein each of said cops has a core and wherein the takeup means comprises a pair of holding elements which grip opposite ends of the core of one of the cops.

5. In a spooling machine in accordance with claim 4 wherein one of said holding elements is operable to hold below one end of the core of one of said cops, the other one of said holding elements having a conical element which is operable to be inserted into the other end of the core of the same one of said cops.

6. In a spooling machine in accordance with claim 4 wherein the pair of holding elements are separately attached to said takeup and discharge means, said takeup and discharge means being relatively and slidably displaceable mutually with respect to each other, the relative displacement of said takeup and discharge means being in the direction of travel on said conveyor path, said takeup and discharge means being mutually displaceable by means of said control motor acting on said takeup and discharge means.

7. In a spooling machine in accordance with claim 6 wherein the control motor is stationary and is operable upon the transport means through said drive means.

8. In a spooling machine in accordance with claim 7 wherein said core of each of said cops has a spool-off end having an end face and a circumferential surface, thread being removed from said spool-off end and wherein the takeup means comprises:

a clamping element for contacting the end face or circumferential surface of said spool-off end of each of the cops.

9. In a spooling arrangement in accordance with claim 8 wherein said drive means comprises:

selection means for producing said routing signal corresponding to a selected one of said winding heads and the distance from it to the delivery point, said control motor being fixedly located and connected with the transport means and said selection means and being responsive to said routing signal, said control motor being operable to complete a selected number of rotations or partial rotations corresponding to and in response to said routing signal, so that said, said transport arrangement can be moved the distance from the delivery point to a predetermined one of said winding heads.

10. In a spooling machine in accordance with claim 9 wherein the control motor comprises:

a stepping motor having a pulse input for receiving pulses, said stepping motor being operable to rotate a predetermined increment in response to each pulse applied to said pulse input, so that the degree of rotation of said stepping motor is controllable by applying to said pulse input a predetermined number of pulses, said selection means being operable to apply to said pulse input said predetermined number of pulses, said predetermined number being sized to correspond to the position of the selected one of said winding heads.

11. In a spooling machine in accordance with claim 9 wherein the drive means comprises:

a pair of belt or chain drive arrangements, each being connected to a different one of said takeup and discharge means of the transport arrangement, said drive means being driveable by said control motor; and a turning arrangement coupled to said control motor and to one of said pair of belt or chain drive arrangements, said turning arrangement being displaceable by said control motor for changing the phasing of said pair of belt or chain drive arrangements.

12. In a spooling machine in accordance with claim 11 wherein said spooling machine has at least two delivery points for said cops, each of the delivery points being supplied with different threads, and each delivery point corresponding to a different corresponding one of said winding heads.

13. In a spooling machine in accordance with claim 1 further including, guide means having a pair of opposing and converging guide members for vertically aligning one of said cops as it is discharged.

* * * * *